US005464969A

United States Patent [19]

Miller

[11] Patent Number: 5,464,969

[45] Date of Patent: Nov. 7, 1995

[54] SELF-VENTING MICROWAVEABLE PACKAGE AND METHOD OF MANUFACTURE

[75] Inventor: Gerald Miller, Oshkosh, Wis.

[73] Assignee: Curwood, Inc., Oshkosh, Wis.

[21] Appl. No.: 337,173

[22] Filed: Nov. 10, 1994

[51] Int. Cl.[6] ..... H05B 6/80

[52] U.S. Cl. ..... 219/735; 219/727; 426/107; 426/118; 426/234; 99/DIG. 14

[58] Field of Search ..... 219/727, 735, 219/730, 759; 426/118, 234, 107, 241, 243; 99/DIG. 14; 206/632

[56] References Cited

U.S. PATENT DOCUMENTS

| | | | |
|---|---|---|---|
| 4,261,504 | 4/1981 | Cowan . | |
| 4,518,087 | 5/1985 | Goglio . | |
| 4,576,285 | 3/1986 | Goglio . | |
| 4,640,838 | 2/1987 | Isakson et al. | 426/107 |
| 4,667,453 | 5/1987 | Goglio . | |
| 4,705,174 | 11/1987 | Goglio | 206/632 |
| 4,786,190 | 11/1988 | Van Erden et al. . | |
| 4,873,101 | 10/1989 | Larson et al. | 426/118 |
| 4,890,439 | 1/1990 | Smart et al. | 426/107 |
| 4,925,684 | 5/1990 | Simon . | |
| 4,944,409 | 7/1990 | Busche et al. | 206/632 |
| 5,003,142 | 3/1991 | Fuller . | |
| 5,041,325 | 8/1991 | Larson . | |
| 5,061,500 | 10/1991 | Mendenhall | 426/118 |
| 5,079,059 | 1/1992 | Wyslotsky . | |
| 5,171,950 | 12/1992 | Brauner et al. | 219/727 |
| 5,195,829 | 3/1993 | Watkins et al. . | |
| 5,287,961 | 2/1994 | Herran . | |
| 5,298,708 | 3/1994 | Babu et al. | 219/728 |

*Primary Examiner*—Philip H. Leung

*Attorney, Agent, or Firm*—Lee, Mann, Smith, McWilliams, Sweeney & Ohlson

[57] ABSTRACT

A self-venting package adapted for microwave cooking having first and second package walls made from thermoplastic polymeric film where the second package wall is joined at a portion of its perimeter to the first package wall thus creating a product receiving chamber defined between the first and second walls. The chamber is adapted to receive a product to be heated and the package is sealed by at least one multilayered seal strip having a thermoplastic polymeric film construction that is placed between the first and second package walls at an edge of the package. The seal strip consists of a first outer layer, positioned adjacent to an inner surface of the first package wall and adapted to be sealed thereto, a second outer layer, positioned adjacent to an inner surface of the second package wall and adapted to be sealed thereto, and a tie layer disposed between the first and the second outer layers where the tie layer is peelably bonded to the first outer layer and the second outer layer. Thus, after the product is introduced into the product receiving chamber and the package is sealed, and sufficient force is exerted against the seal strip from pressure generated internal to the product receiving chamber, venting of the package will take place through the seal strip to thereby reduce the internal pressure within the chamber and prevent explosion of the package during heating.

10 Claims, 1 Drawing Sheet

10
12
14
15A
15B
15C
15D
16
18
20
22
24
26
27
28
30
31
32
32A
40
42A
42B
5

SELF-VENTING MICROWAVEABLE PACKAGE AND METHOD OF MANUFACTURE

BACKGROUND OF THE INVENTION

The present invention is directed to a self-venting microwaveable package and its method of manufacture. The package is adapted to sealably contain a liquid or solid or semi-solid to be heated. When an air-tight unvented package is heated in a microwave oven, pressure builds up in the sealed package holding the product. After a critical internal pressure is reached, the package can explode, spattering its contents over the oven interior.

Numerous approaches have been utilized in attempts to solve this problem. One microwaveable package, illustrated in U.S. Pat. No. 5,298,708 to Babu, teaches a microwaveable tape that absorbs radiation and converts it to heat. The tape is actually secured onto the top of the bag to be microwaved. The tape is used to vent bags by absorbing radiation, convening it to heat, and then having the heat flow to the plastic, where it softens the plastic so that internal bag pressure bursts the plastic and allows the pressurized vapor to vent. This tape is not meant to form a peelable opening nor is it meant to vent by having the layers forming the seal of the bag separate. The tape is expensive to manufacture, especially the microwave active layer. Furthermore, the size and location of the hole formed in the bag is unpredictable, and may lead to spills either during microwaving or when trying to remove the substance heated. Thus, the package is unsuitable for holding liquids or semi-liquids.

Another microwaveable bag of the same type is taught by U.S. Pat. No. 4,640,838 to Isakson. In Isakson, a deposit of a microwave-absorbing substance such as graphite is deposited on the surface of the package. The package then operates just like that disclosed by Babu. This package has the same disadvantages as Babu does, i.e., it is unsuitable for use with liquids or semi-liquids.

Yet another prior art package is disclosed by U.S. Pat. No. 5,061,500, issued to Mendenhall. Mendenhall's package, primarily designed for popcorn, does not handle liquids well. The bag disclosed by Mendenhall was comprised of an outer layer of paper or polymer film, and an inner layer of a heat sealable polyester composite film. The bag lacked the structural strength to hold high-density fluids and viscous substances.

U.S. Pat. Nos. 4,576,285, 4,667,453 and 4,705,174, all to Goglio, lack the crucial self-venting feature of the instant invention. Furthermore, these inventions have excess multiple layers in the seal which are unnecessary, thus increasing the costs of manufacture and resulting in extra, wasteful pollution.

An easy open package is illustrated and described in U.S. Pat. No. 4,944,409. A tie layer forms a constituent layer of one package wall and is peelably bonded to one package wall and permanently bonded to another. The tie layer however is not in a limited strip area and adds a good deal of expense to the overall package and does not allow controlled venting.

None of the prior art patents provide a self-venting microwaveable package that is capable of holding liquids or semi-liquids, self-vents, provides for easy pouring of the heated product and is easily opened at its top closure without the need for additional structural material.

SUMMARY OF THE INVENTION

The present invention provides a self-venting, peelably opening microwaveable package adapted for holding and heating a variety of products including liquids. The self-venting package is adapted to be filled with product and then heat sealed to a closed condition to protect and seal the product placed therein. The package will self-vent upon microwaving to relieve internal pressure and to prevent explosion. The self-venting package includes a first package wall joined at a portion of its periphery to a second package wall. The first and second package walls are comprised of a thermoplastic polymeric film construction typically having outer and inner layers. The first and second package walls define a product receiving chamber between them and the chamber is adapted to receive the product to be heated. The product may be solid or liquid and may be frozen or unfrozen.

A multilayer seal strip having a thermoplastic polymeric film construction is disposed between the first and second package walls along at least a portion of one or more edges of the package. The seal strip consists of a first outer layer positioned adjacent to an inner surface of the first package wall and a second outer layer positioned adjacent to an inner surface of the second package wall. A tie layer is placed between the first and second outer layers. The tie layer preferably consists of polybutylene and at least one other constituent. The tie layer is bonded to the first outer layer and the second outer layer.

This creates a package with a receiving chamber into which the product can be introduced. The package can then be sealed along the remaining edge such that when force is exerted against the seal strip, as a result of pressure generated in the product receiving chamber, the package self-vents through the seal strip. This relieves the internal pressure within the product receiving chamber and prevents any possible explosions.

DESCRIPTION OF THE PREFERRED EMBODIMENT

Figures 1, 2, 3, 4, 5, 6:
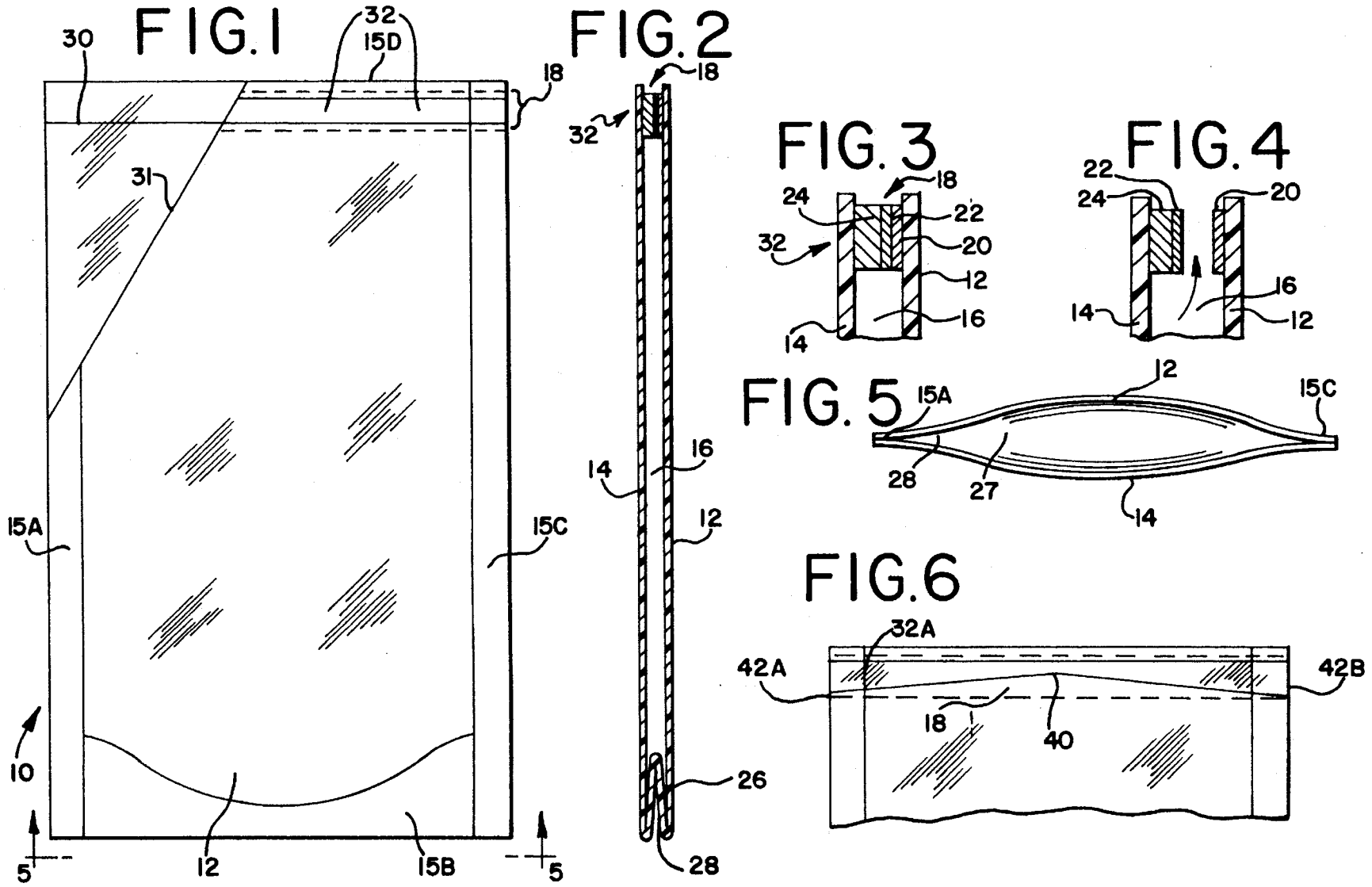
FIG. 1 is a front view of a self-venting package.
FIG. 2 is a side view of the package illustrated in FIG. 1
FIG. 3 is an enlarged side view of the seal portion of the package illustrated in FIG. 1 showing the seal strip after having been sealed.
FIG. 4 is an enlarged side view of the seal portion of the package showing the seal in the venting mode.
FIG. 5 is a bottom view of the preferred embodiment showing the gusset for self-standing and the finger receiving chamber.
FIG. 6 is a front view of an alternate embodiment of the self-venting package.

One embodiment of a self-venting, microwaveable package is shown in FIGS. 1–5 of the drawings. The package 10 which is illustrated is formed of a single sheet of polymeric plastic packaging film sealed at a portion of the perimeter and includes a first package wall, generally designated by the numeral 12, and a second package wall, generally designated by the numeral 14. The two package walls 12 and 14 may be joined about three edges 15A, 15B and 15C to form a package with an opening at the upper edge 15D through which product may be inserted. The product is deposited in the product receiving chamber 16. The product may be any of a wide variety of food or non-food items, but the package of the present invention has been found to be particularly useful for heating liquids and semi-solids. One example is frozen nacho cheese sauce, which can be heated in a microwave oven and poured over tortilla chips. The package illustrated in FIGS. 1 and 2 is formed by using a single sheet of film, folded over on itself at the bottom or side edge and sealed along other edges. Additionally, a package could be formed from separate sheets of film material, one for each side wall and one forming the bottom wall or some modification thereof.

For most applications the package walls 12 and 14 will be made of identical film, but that is not necessarily the case. It is possible to form a package having front and/or back and/or bottom walls of different film materials. It is also possible to eliminate a bottom wall or gusset and seal the package walls 12 and 14 together along the bottom edge. Each package wall is preferably made of a thermoplastic polymeric coextruded film such as CURLAM grade 8181-0 film or LIQUIFLEX 8231-K film, both made by Curwood, Inc. of Oshkosh, Wis. CURLAM 8181-0 film is a coextrusion with an outer layer of 50 gauge oriented polyethylene terephthalate (OPET) and an inner layer of 4.0 mils of linear low density polyethylene (LLDPE) joined by a layer of adhesive. The resultant film is a flexible, nonforming web suitable for packaging of frozen products. Such a film is especially designed to provide strength and durability with moderate oxygen and moisture vapor transmission rates.

LIQUIFLEX 8231-K film is also a coextruded thermoplastic polymeric film and is made up of an outer layer of 60 gauge biaxially oriented nylon (BON) and an inner layer of 3.0 mils of ethylene vinyl alcohol (EVOH) joined by a layer of adhesive. The coextrusion results in a film having excellent barrier properties with minimal flex or stress cracking. This film has excellent tearing characteristics for easy opening. The 8181-0 film has a relatively low oxygen barrier whereas the 8231-K film has a relatively high oxygen barrier.

In the embodiment illustrated in the drawings, the two package walls are formed from a single sheet of film folded over at the bottom and are heat sealed together along edges 15A and 15C by the application of heat and pressure under conditions which are well known in the art. The sealing conditions may vary depending on the particular films which are used and their thicknesses.

A multilayered seal strip 18, best shown in FIG. 3, is positioned between package walls 12 and 14 at the upper edge of the package. The strip 18 is composed of a first outer layer 20, a tie layer 22 and a second outer layer 24. The first outer layer 20 and the second outer layer 24 are normally formed of the same constituents and may be composed of substantially 100% of a first constituent including ethylene vinyl acetate copolymer, linear low density polyethylene, low density polyethylene, neutralized ethylene acid copolymer or other suitable extrudable polyolefin polymers or copolymers, such as ethylene acrylate copolymer or ethylene methyl acrylate copolymer, or it may be composed of at least 50% of one of the constituents and a correlative percentage of another of the constituents. The thickness of layer 20 is preferably within the range of 0.1 mil to 0.5 mil. The thickness of layer 24 is preferably within the range of 0.5 mil to 4.0 mils.

The tie layer 22 is selected to have a relatively low peel strength when peelably bonded to either the first outer layer 20 or the second outer layer 24, as previously described. The thickness of the tie layer 22 should be between 0.1 and 0.5 mil thick with 0.2 mil optimum for most applications. It is generally comprised of a combination of polybutylene and either ethylene vinyl acetate copolymer, linear low density polyethylene (LLDPE), neutralized ethylene acid copolymer or unneutralized ethylene acid copolymer. The blends of polybutylene and the above polymers produce a tie layer 22 having optical clarity.

In the illustrated embodiment, the composition of the tie layer 22 is dissimilar to the composition of both the second outer layer 24 and the first outer layer 20. Thus the bond strength between the outer layers 24 and 20 and the tie layer 22 will be less than the heat seal strength between the layers 20 and 12, as well as between layers 24 and 14. Therefore, as indicated in FIG. 4, vent or peel failure is designed to occur in the tie layer 22 or its interface with layers 24 or 20. The force required to achieve vent or peel failure will vary depending upon a number of factors including the dimensions of the seal strip as well as the constituent components thereof.

FIG. 4 illustrates an arrangement wherein the vent or peel failure occurs between the first outer layer 20 and the tie layer 22. The first outer layer 20 in this arrangement is composed of either 100% ethylene vinyl acetate (EVA) or 50% EVA and 50% LLDPE. The second outer layer 24 is comprised of materials similar or identical to first outer layer 20 and the tie layer 22 is composed of 85% ethylene or ethylene copolymer and 15% polybutylene. Venting or peeling is illustrated between the first outer layer 20 and the tie layer 22, but it can also occur between second outer layer 24 and tie layer 22 or within tie layer 22 itself or as a combination of two or three of these failure points.

While the embodiment described above defines layers composed of specific percentages of each material, it is understood that these percentages are not absolute and may vary within predetermined ranges. For example, while the tie layer 22 is described in one embodiment as being 15% polybutylene, the actual percentage of polybutylene in the tie layer 22 may range from between 5% and 30% and still be effective in determining the point of venting or peeling. The higher the content of polybutylene in the tie layer 22, the lower the vent or peel failure value, that is, the stronger the bond strength of the tie layer 22. The bond strength is modified by the percentage of polybutylene therein.

FIG. 2 illustrates a side-view of the entire package in the sealed condition. A gusset 26 or fold line can clearly be seen at the bottom of the package. This gusset is also illustrated in FIG. 5. The preferred embodiment of the package includes the gusseted arrangement because this assists in forming a self-standing package which is helpful for packages designed to contain liquid. If a package filled with frozen nacho cheese were to be heated in a microwave oven, the package could not be laid on its side if designed to self-vent along the top edge. The gusset provides a sturdy, relatively stable base support that helps prevent tipping of the package when stood upright in a microwave oven which has a rotatable tray. If the gusset is not used and the package walls 12 and 14 are sealed together along the bottom edge 15B in the same manner as the sides 15 A and 15C, such a package can be placed in a paper cup or some other container for stability during heating. In the illustrated embodiment, a bottom package wall 28, can be used to space apart package walls 12 and 14 at the bottom and vertically self-support the package during heating. The gusset 26 and the bottom package wall 28 form a finger receiving chamber 27, which can be used to pick up the package after heating.

An optional gripping flange 30 is illustrated in FIG. 1. The flange 30 is formed by sealing package walls 12 and 14 together along the line 31. This precludes product from entering this area and provides a flange which is cooler than the product receiving chamber after cooking. It can be used to hold the package in one hand while the package 10 is tipped with the finger placed in the finger receiving chamber 27.

In the embodiment illustrated in FIG. 1, a seal 32 is formed across the entire width of the top of the package 10. This seal is normally formed by the application of heat and pressure as is well known to those of ordinary skill in the packaging art. In the embodiment of FIG. 1, a heated seal bar is pressed against the outer surface of the package wall 14. When pressure is applied, the upper end of the package is forced against a backing plate (not shown). The seal bar is rectangular in shape and has a vertical dimension equal to or less than the vertical dimension of the seal strip 18. This causes package wall 14 to seal to layer 24, which in turn seals to layer 22, which seals to layer 20, which seals to package wall 12. This creates the seal 32 shown in FIG. 1.

FIG. 6 illustrates a package of the same construction as the package of FIG. 1 but with a modified seal shape, designated as 32A. The seal strip 18 is identical to that illustrated in FIG. 1. The seal 32A is formed with a chevron configuration with a peak 40 at a point where the vertical dimension of the seal is relatively narrow compared to the vertical dimension measured at points 42A and 42B located at the left and right ends of the seal 32A. The purpose of such an arrangement is to predetermine the location where the seal will vent. In the embodiment of FIG. 1, the seal 32 may vent at any point across its width. In the embodiment of FIG. 6, the seal 32A will always vent at the peak 40.

For most applications, the side seals for the package and the bottom seal, if necessary, will be formed initially leaving the package open at its upper end. The package will then be filled and sealed along the upper edge to effect a completely sealed package. Alternatively, for some applications, it may be preferable to fill the package from its bottom end. In this embodiment the side seals and top seal are made first, leaving the bottom end of the package open. The product is then introduced into the product receiving chamber from the open bottom which is then sealed.

The seal 32 has a predetermined height. The seal strip 18 must be of equal or greater height than the seal 32 so that a path can be formed from the product receiving chamber to the outer atmosphere for the flow of vapor. Otherwise, the seal strip will peel and part, but the remaining seal will prevent the venting of the product receiving chamber.

In another embodiment of the invention (not shown), the multilayered seal strip can be strategically placed so as to vent at a particular pour spout location or at more than one location. This can be done by providing a seal strip which is shorter in width, placed at the desired pour spot for liquid containers, or by providing a number of short seal strips with each strip spaced laterally from an adjacent strip.

In yet another embodiment of the invention (not shown), the multilayered seal strip can run across part of the top, and then down part of the side of the package, to form a type of pouring spout. This spout would be located across from the gripping flange and diagonally across from the finger receiving chamber. Alternatively the seal strip could be positioned diagonally across a comer of the package.

Thus, it has been shown that the present invention provides a self-venting package suitable for microwaving liquids and other products, and a method of manufacture thereof. The package can be made to vent or peel at a predetermined location, if desired, by careful placement and construction of the multilayered seal strip or by designing a specific seal pattern.

Various embodiments of the invention have been particularly shown and described in connection with the illustrated embodiment of the invention, however, it must be understood that these particular arrangements merely illustrate and that the invention is to be given its fullest interpretation within the terms of the appended claims.

What is claimed is:

1. A self-venting package adapted for microwave cooking including a first package wall composed solely of a thermoplastic polymeric film construction free of susceptor materials; a second package wall also composed solely of a thermoplastic polymeric film construction free of susceptor materials, said second package wall joined at a portion of its perimeter to said first package wall; a product receiving chamber defined between said first and said second walls, said chamber adapted to receive a product to be heated; a seal strip disposed between said first and second package walls at an edge of said package, said seal strip having at least three layers of thermoplastic polymeric film construction and consisting of a first outer layer, positioned adjacent to an inner surface of said first package wall and adapted to be sealed thereto, a second outer layer, positioned adjacent to an inner surface of said second package wall and adapted to be sealed thereto, and a tie layer disposed between said first and said second outer layers, said tie layer being peelably bonded to said first outer layer and said second outer layer, whereby, after product is introduced into said product receiving chamber and said package is sealed, when sufficient force is exerted against said seal strip from pressure generated internal to said product receiving chamber, said tie layer will separate from one of said outer layers to which it is sealed and venting of said package will take place through said seal strip to thereby reduce the internal pressure within said chamber and prevent explosion of said package during heating.

2. A package in accordance with claim 1, said package further comprising a gusset formed at a bottom end of said package, said gusset forming a bottom package wall joined to said first package wall and said second package wall, said bottom wail adapted to provide a stable base to assist in supporting said package in a vertically upright position during microwave heating.

3. A package as in claim 1 in which a plurality of said seal strips are disposed between said first and second walls, each seal strip spaced laterally from adjacent seal strips, so as to provide a plurality of self-venting openings in said package.

4. A package as in claim 1 in which a single seal strip is disposed between said first and said second package walls and extends from one edge of said package to an opposite edge of said package.

5. A package as in claim 1 including a seal extending across one edge of said package and sealing said first package wall, said seal strip and said second package wall together, said seal having a predetermined height and said seal strip having a height equal to or greater than the height of said seal to insure venting of said product receiving chamber through said seal strip.

6. A package as in claim 1 including a gripping flange formed at one comer of said package by sealing said first and said second package walls together whereby said flange facilitates gripping of a heated package for emptying of its contents.

7. A package as in claim 1 including a chamber formed at a bottom edge of said package, said chamber formed by sealing said first and said second package walls together at the left and fight sides of said package thereby defining a chamber between said edges for insertion of a finger or implement to facilitate emptying of the contents of a heated package.

8. A package as in claim 1 in which said tie layer comprises a combination of polybutylene and at least one other constituent.

9. A method of forming a self-venting package adapted for microwave cooking, the steps of the method comprising:

joining a first package wall and second package wall both formed solely of thermoplastic polymeric film construction free of susceptor materials along at least two edges thereof to form a product receiving chamber;

placing a multilayered thermoplastic seal strip between said first and second package walls;

sealing a first outer layer of said seal strip to an inner surface of said first package wall;

sealing a second outer layer of said seal strip to an inner surface of said second package wall;

bonding a tie layer of said seal strip to said first outer layer and said second outer layer;

whereby, after the product is introduced into said product receiving chamber and said package is sealed, said package is self-venting through said seal strip.

10. A method of forming a self-venting package as in claim 9 including the steps of: introducing product into said product receiving chamber, and sealing said first and second package walls together along any remaining unsealed area.

* * * * *